US009567748B2

(12) United States Patent
Cheung

(10) Patent No.: US 9,567,748 B2
(45) Date of Patent: Feb. 14, 2017

(54) PINNACLE TRUSS

(71) Applicant: Charles Cheung, New Taipei (TW)

(72) Inventor: Charles Cheung, New Taipei (TW)

( * ) Notice: Subject to any disclaimer, the term of this patent is extended or adjusted under 35 U.S.C. 154(b) by 0 days.

(21) Appl. No.: 14/799,682

(22) Filed: Jul. 15, 2015

(65) Prior Publication Data

US 2016/0090733 A1 Mar. 31, 2016

(30) Foreign Application Priority Data

Sep. 30, 2014 (TW) ..... 103217352 U

(51) Int. Cl.
*E04B 1/41* (2006.01)
*E04C 3/11* (2006.01)
*E04C 3/04* (2006.01)

(52) U.S. Cl.
CPC ..... *E04C 3/11* (2013.01); *E04C 2003/0491* (2013.01)

(58) Field of Classification Search
CPC ..... E04B 1/40; E04C 3/11; E04C 3/04; E04C 2003/0486
USPC ..... 52/634, 635, 638, 639, 656.9
See application file for complete search history.

(56) References Cited

U.S. PATENT DOCUMENTS 4,616,453 A * 10/1986 Sheppard, Jr. ..... E04C 3/07 52/478
5,802,772 A * 9/1998 Burke ..... E04H 3/24 52/6
5,819,494 A * 10/1998 Haisch ..... E04C 3/11 403/283
6,634,153 B1 * 10/2003 Peterson ..... E04C 3/08 52/695
7,409,804 B2 * 8/2008 Moody ..... E04C 3/292 52/639
7,739,850 B2 * 6/2010 Daudet ..... E04B 1/24 52/210
7,748,546 B2 * 7/2010 Konstant ..... A47B 47/021 211/189
7,856,786 B2 * 12/2010 Beck ..... E04B 1/24 52/236.3
8,297,009 B2 * 10/2012 Yamamoto ..... H02S 30/10 136/251
2002/0020133 A1 * 2/2002 Embury ..... E04C 3/11 52/634

(Continued)

FOREIGN PATENT DOCUMENTS

CA 2481347 A1 * 4/2005 ..... E04B 9/00

OTHER PUBLICATIONS

Office Action issued Oct. 22, 2015 in corresponding New Zealand application.

*Primary Examiner* — Joshua J Michener
*Assistant Examiner* — Keith Minter
(74) *Attorney, Agent, or Firm* — Bacon & Thomas, PLLC

(57) ABSTRACT

A pinnacle truss has a first linear support member, a second linear support member stacked on the first support member and a third linear support member stacked on the first support member and the second linear support member. The first linear support member, the second linear support member, and the third linear support member form a triangular support structure. The first linear support member has an L-shaped cross section. The second linear support member and the third linear support member each has a C-shaped cross section.

8 Claims, 8 Drawing Sheets

(56) References Cited

U.S. PATENT DOCUMENTS

| | | | | |
|---|---|---|---|---|
| 2005/0229528 | A1* | 10/2005 | Kardosz | E04C 3/11 52/639 |
| 2006/0185267 | A1* | 8/2006 | Tonyan | B28B 1/522 52/90.1 |
| 2008/0178555 | A1 | 7/2008 | Green et al. | |
| 2010/0077692 | A1* | 4/2010 | Dunbar | E04C 3/07 52/636 |
| 2010/0223877 | A1* | 9/2010 | O'Hara | E04C 3/11 52/636 |
| 2013/0326993 | A1* | 12/2013 | Schold | E04B 1/185 52/655.1 |

* cited by examiner

PINNACLE TRUSS

FIELD OF THE INVENTION

This invention relates to a support device, in particular, to a pinnacle truss.

BACKGROUND OF THE INVENTION

The prior frame has a first side C-shaped groove member, a second side C-shaped groove member and an intermediate C-shaped groove member. The first side C-shaped groove member and the second side C-shaped groove member are linked to each other with an angle through the intermediate C-shaped groove member. In other words, a middle section of the first side C-shaped groove member is connected to a most left section of the intermediate C-shaped groove member, a right section of the first side C-shaped groove member is connected to an upper left section of the intermediate C-shaped groove member, a middle section of the second side C-shaped groove member is connected to a most right section of the intermediate C-shaped groove member, and a left section of the second side C-shaped groove member is connected to an upper right section of the intermediate C-shaped groove member, thereby forming a trapezoidal structure with four connection points. The first side C-shaped groove member, the second side C-shaped groove member and the intermediate C-shaped groove member have grooves all towards the same direction. In the prior frame, the first side C-shaped groove member and the second side C-shaped groove member are linked to each other through the intermediate C-shaped groove member. The first side C-shaped groove member and the second side C-shaped groove member are linked to each other with a gap instead of direct connection. Since the first side C-shaped groove member and the second side C-shaped groove member are not directly connected to each other, it readily results in the production of stress and strain in the gap, and thus the overall structure of the frame is not strong enough. Therefore, it is necessary to provide solutions to improve the prior frame.

SUMMARY

The following provides fundament of some aspects of this invention through describing simple contents of this invention without intending to recognizing essential or critical elements or delineating the scope of this invention. The purpose is only for introducing more detailed description later via some concepts in simple form.

In order to achieve an objective, this invention provides a pinnacle truss comprising: a first linear support member having a first central axis line, the first linear support member comprising: a first plate extending along the first central axis line, the first plate comprising a first top surface and a first bottom surface opposite to the first top surface; a first wall formed on the first top surface via bending from one side of the first plate and extending along the first central axis line; and a first eaves located above the first top surface via bending from one side of the first wall and extending along the first central axis line, the first eaves, the first wall and the first plate forming an L-shaped cross section in a radial direction of the first linear support member; a second linear support member having a second central axis line intersecting the first central axis line, the second linear support member comprising: a second plate extending along the second central axis line, the second plate comprising a second top surface and a second bottom surface opposite to the second top surface, a segment of the second bottom surface positioned at one end of the second plate being stacked on a segment of the first top surface positioned at one end of the first plate; a second front wall and a second rear wall formed on the second top surface via bending from both sides of the second plate, respectively, and extending along the second central axis line, the second front wall being located between the first wall and the second rear wall; and a second front eaves and a second rear eaves located above the second top surface via bending towards each other from one side of the second front wall and one side of the second rear wall, respectively, and extending along the second central axis line, the second front eaves, the second front wall, the second plate, the second rear wall and the second rear eaves forming a C-shaped cross section in a radial direction of the second linear support member; and a third linear support member having a third central axis line intersecting the first central axis line and the second central axis line, the third linear support member comprising: a third plate extending along the third central axis line, the third plate comprising a third top surface and a third bottom surface opposite to the third top surface, segments of the third bottom surface positioned at one end and the other end of the third plate being stacked on a segment of the second top surface positioned at the other end of the second plate and a segment of the first top surface positioned at the other end of the first plate, respectively; a third front wall and a third rear wall formed on the third top surface via bending from both sides of the third plate, respectively, and extending along the third central axis line, the third front wall being located between the first wall and the third rear wall; and a third front eaves and a third rear eaves located above the third top surface via bending towards each other from one side of the third front wall and one side of the third rear wall, respectively, and extending along the third central axis line, the third front eaves, the third front wall, the third plate, the third rear wall and the third rear eaves forming a C-shaped cross section in a radial direction of the third linear support member.

Accordingly, since the first linear support member, the second linear support member and the third linear support member form a triangular structure with three connection points, and since the second linear support member and the third linear support member are directly connected to each other without any gap therebetween, any potential stress and strain can be eliminated for strengthening the overall structure.

DETAILED DESCRIPTION

Figure 1:
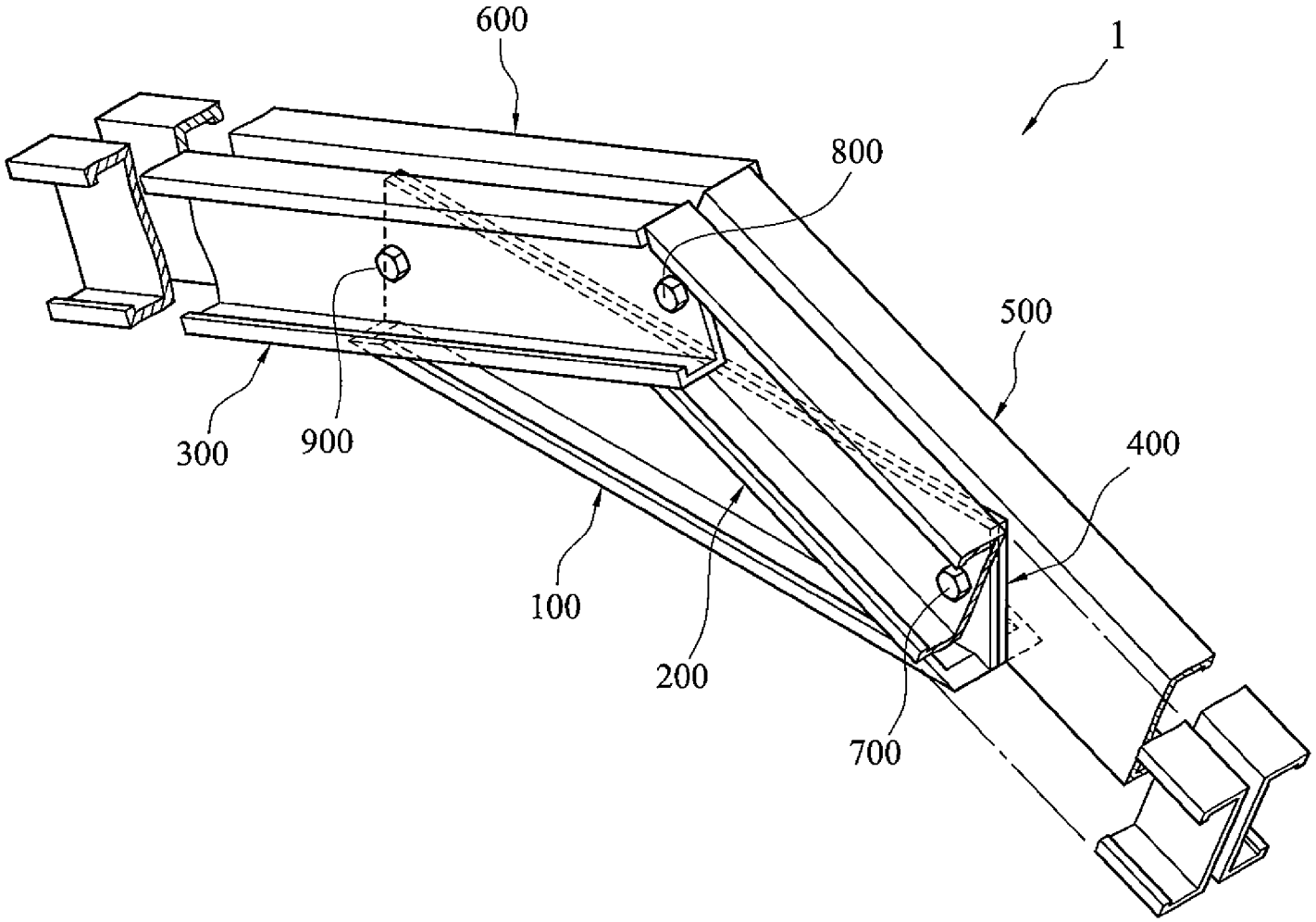
FIG. 1 illustrates a solid assembly view according to an aspect of a pinnacle truss of this invention.
Figure 2:
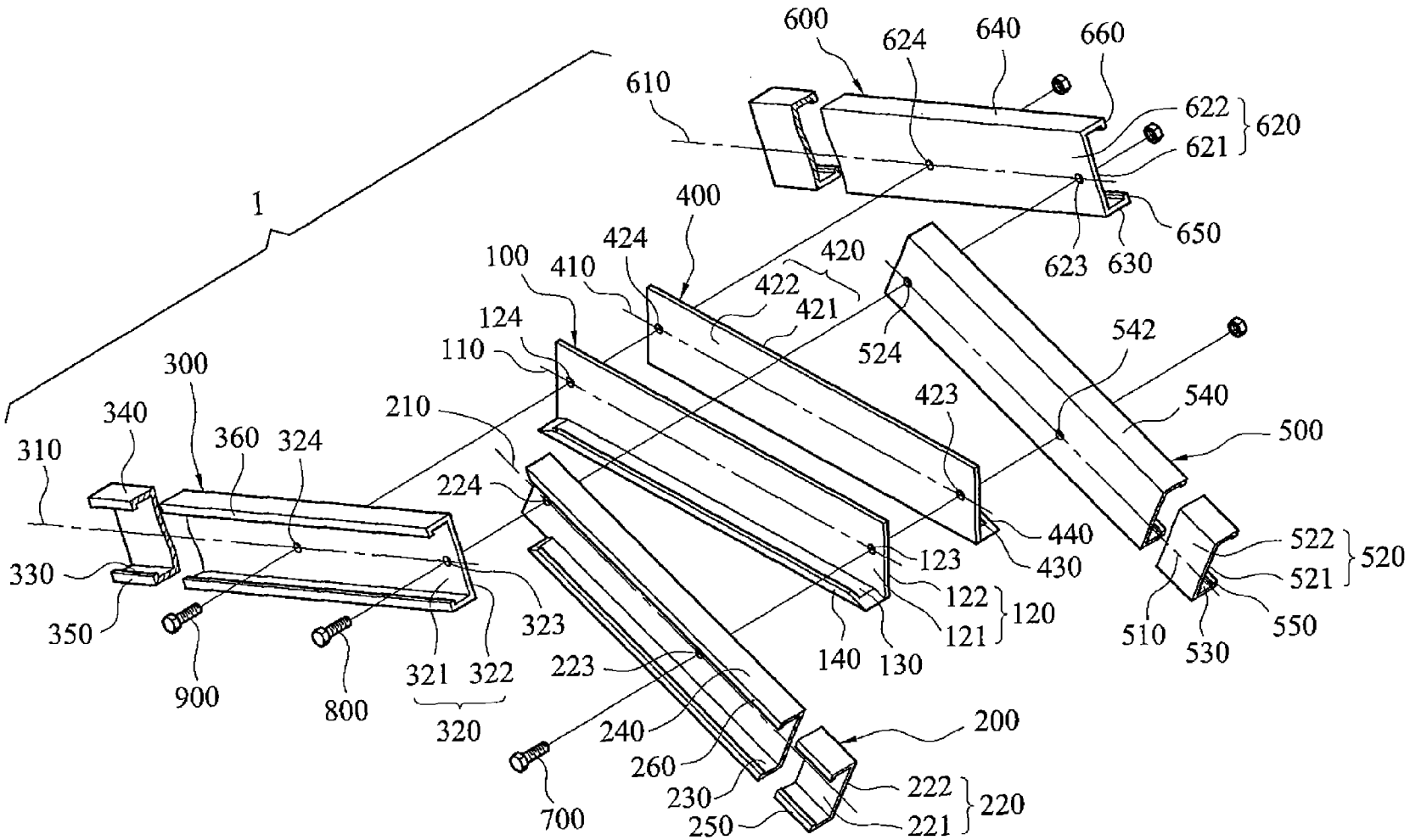
FIG. 2 illustrates a solid explosion view according to an aspect of a pinnacle truss of this invention.
Figure 3:
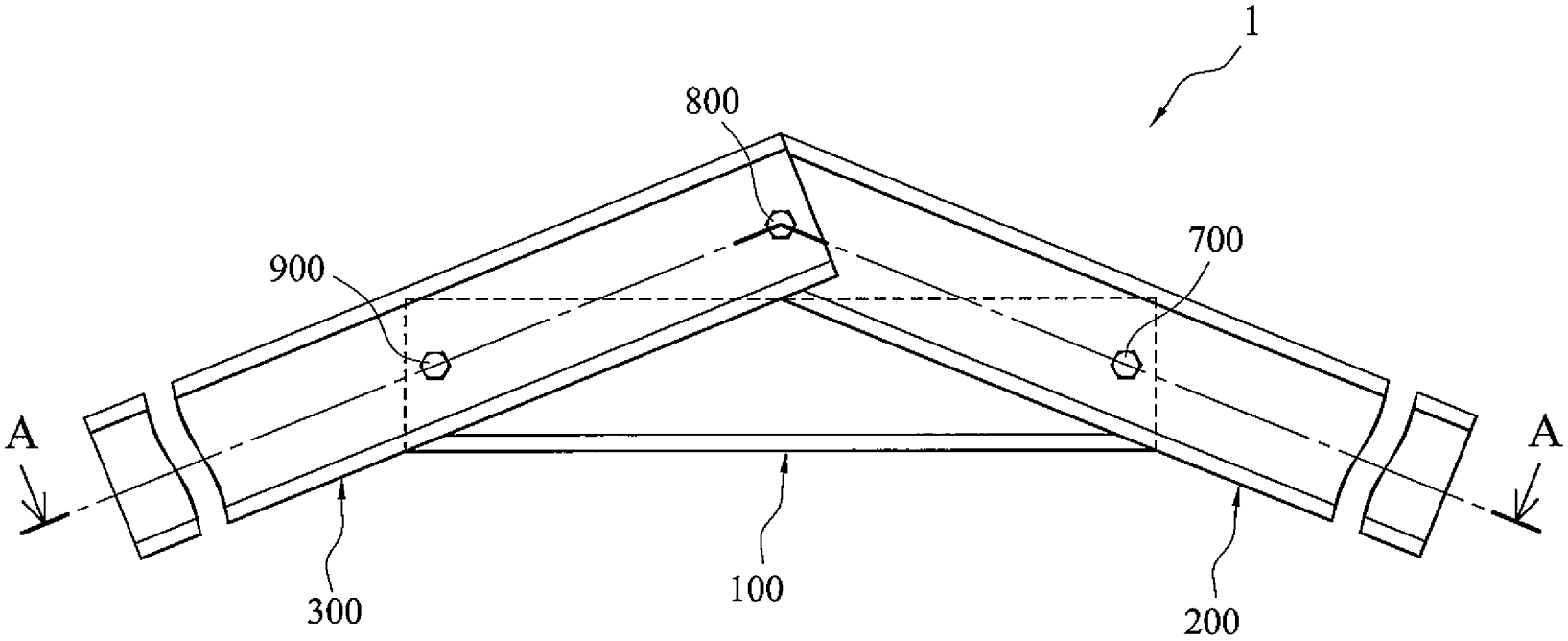
FIG. 3 illustrates a top assembly view according to an aspect of a pinnacle truss of this invention.
Figure 4:
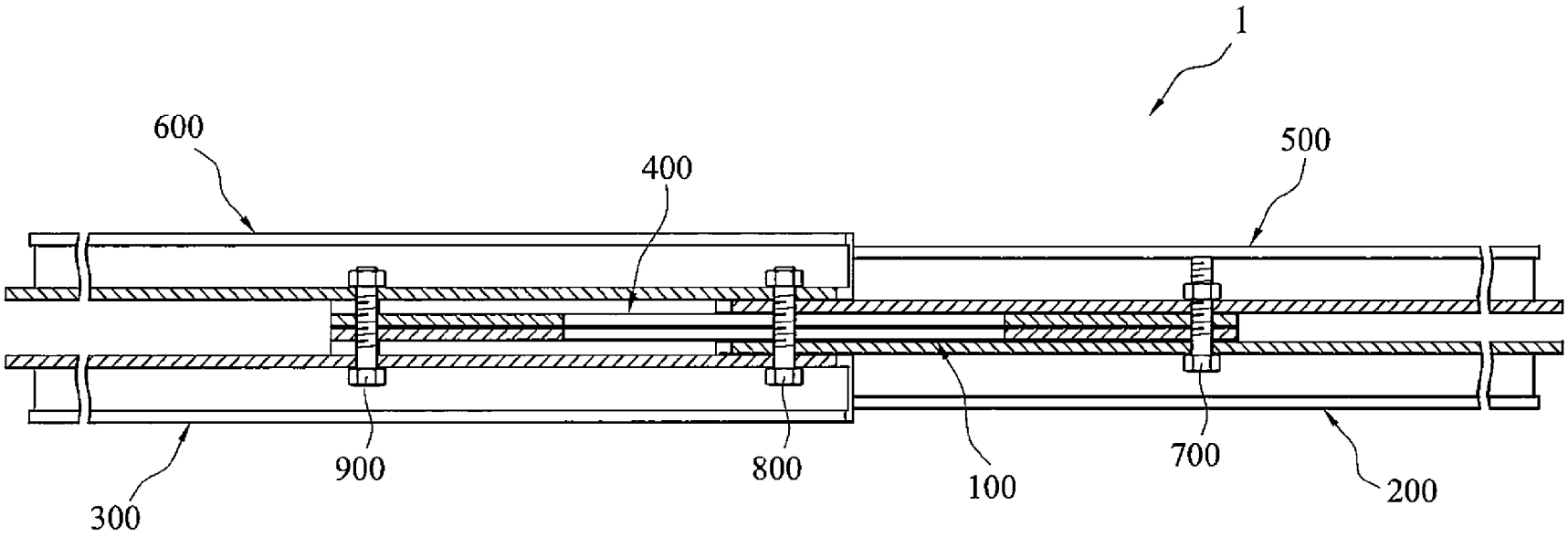
FIG. 4 illustrates a cross-sectional assembly view along line A-A of FIG. 3.
Figure 5:
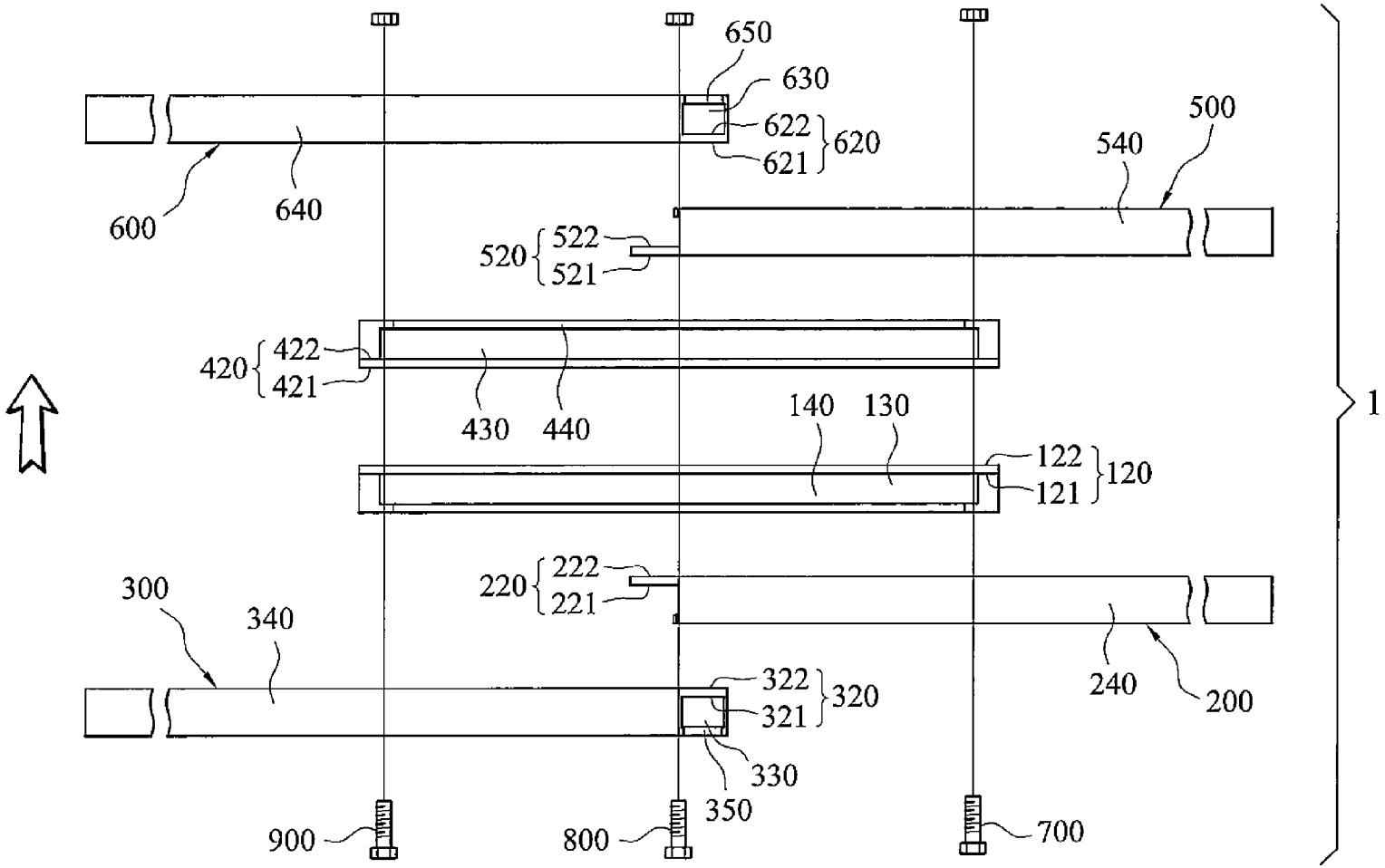
FIG. 5 illustrates a top explosion view according to an aspect of a pinnacle truss of this invention.

Referring now to the attached drawings for the description of this invention, various structures, systems and devices are schematically depicted in the drawings only for the purpose of illustration without obscuring this invention by details known by persons skilled in the art. However, it still contains the attached drawings to describe and illustrate the embodiments of this invention. Words and phrases used herein should be understood and interpreted as those with consistent meaning by persons skilled in the art. Terms and phrases consistently used here are not intended to imply specific definition, namely different from general and conventional definition known by persons skilled in the art. Terms or phrases are intended to expand specific definition, for example, definition outsides the understanding by persons skilled in the art. This specific definition will be clearly expressed in this specification in such a way that specific definition is directly and definitely provided to terms or phrases.

According to FIGS. 1 to 7, in an embodiment of this invention, a pinnacle truss 1 comprises a first linear support member 100, a second linear support member 200 and a third linear support member 300. The first linear support member 100, the second linear support member 200 and the third linear support member 300 each generally is rectangular.

Figure 7:
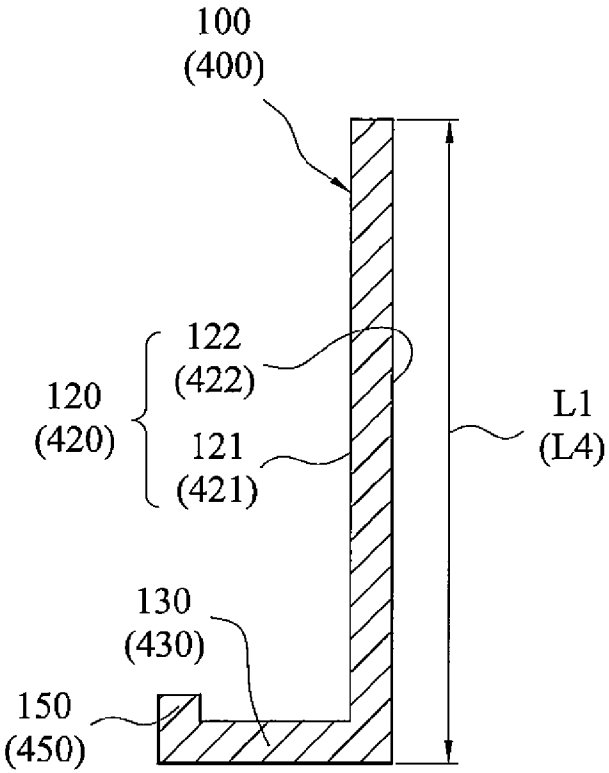
FIG. 7 illustrates a radial cross-section view according to an aspect of a first linear support member or a fourth linear support member of this invention.

The first linear support member 100 has a first central axis line 110. The first linear support member 100 comprises a first plate 120, a first wall 130 and a first eaves 140. The first plate 120 extends along the first central axis line 110. The first plate 120 comprises a first top surface 121 and a first bottom surface 122 opposite to the first top surface 121. The first wall 130 is formes on the first top surface 121 via bending from one side (a front side) of the first plate 120 with an angle of generally 90 degrees and extending along the first central axis line 110. The first eaves 140 is located above the first top surface 121 via bending from one side of the first wall 130 with an angle of generally 90 degrees and extending along the first central axis line 110. The first eaves 140, the first wall 130 and the first plate 120 generally form an L-shaped cross section in a radial direction of the first linear support member 100 (as illustrated in FIG. 7). For example, the first linear support member 100 can be formed by cutting C-shaped steel, but not limited to this specific material or this forming method.

Figure 6:
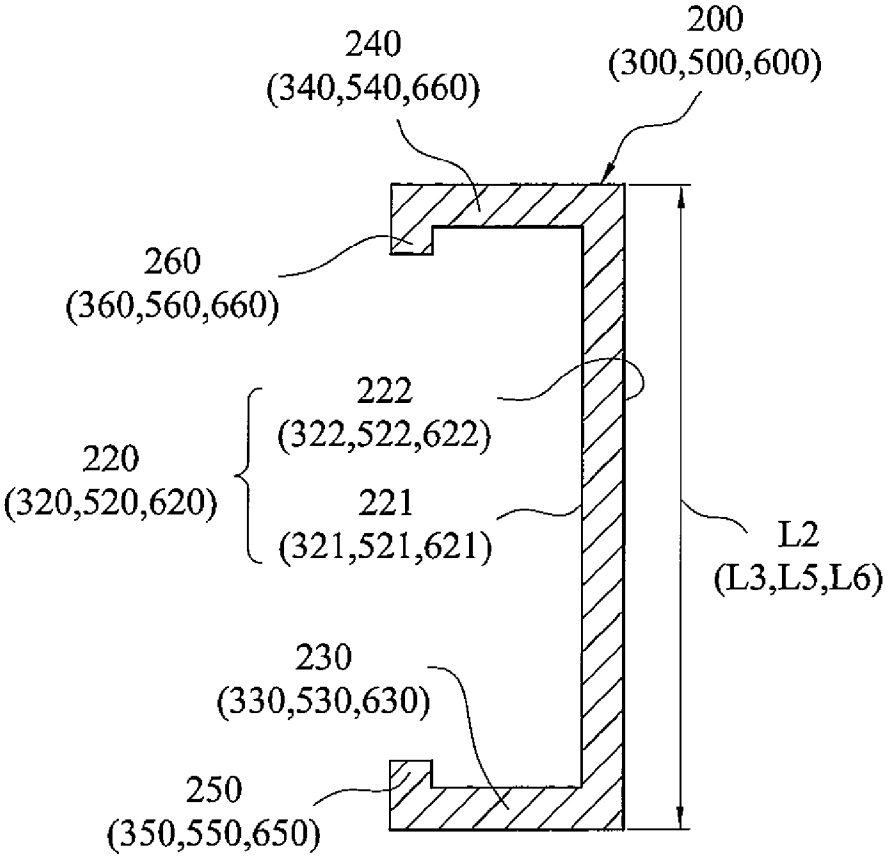
FIG. 6 illustrates a radial cross-section view according to an aspect of a second linear support member or a third linear support member or a fifth linear support member or a sixth linear support member of this invention.
Figure 8:
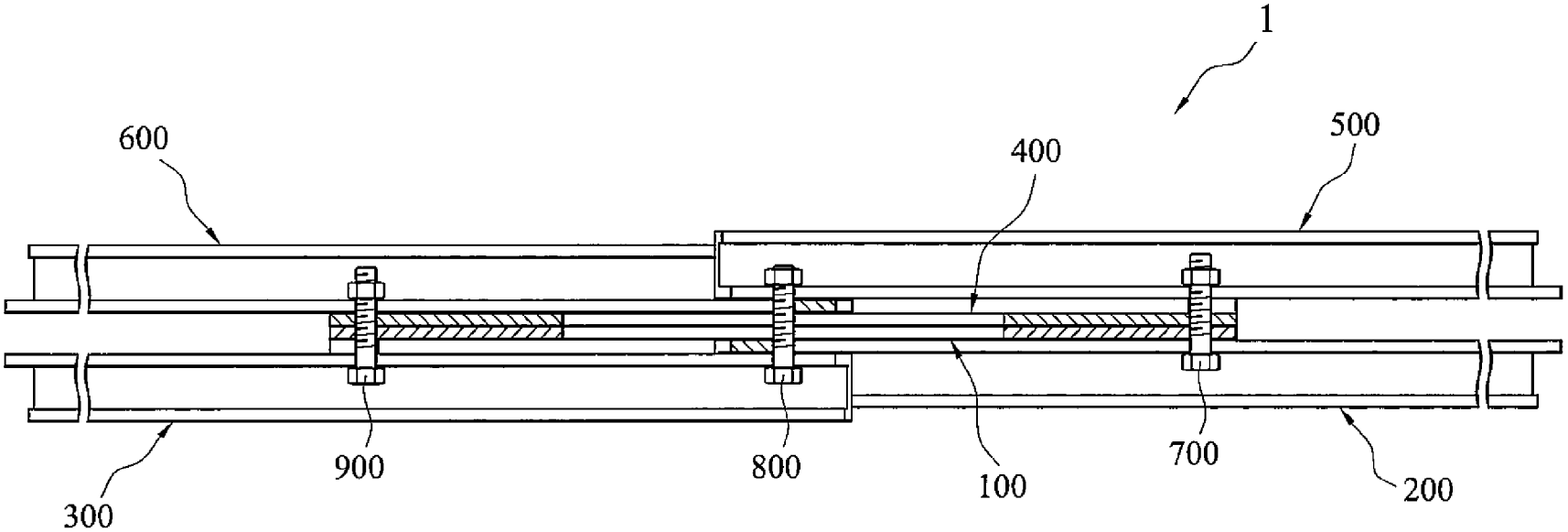
FIG. 8 illustrates a cross-sectional assembly view according to another aspect of a pinnacle truss of this invention.
Figure 9:
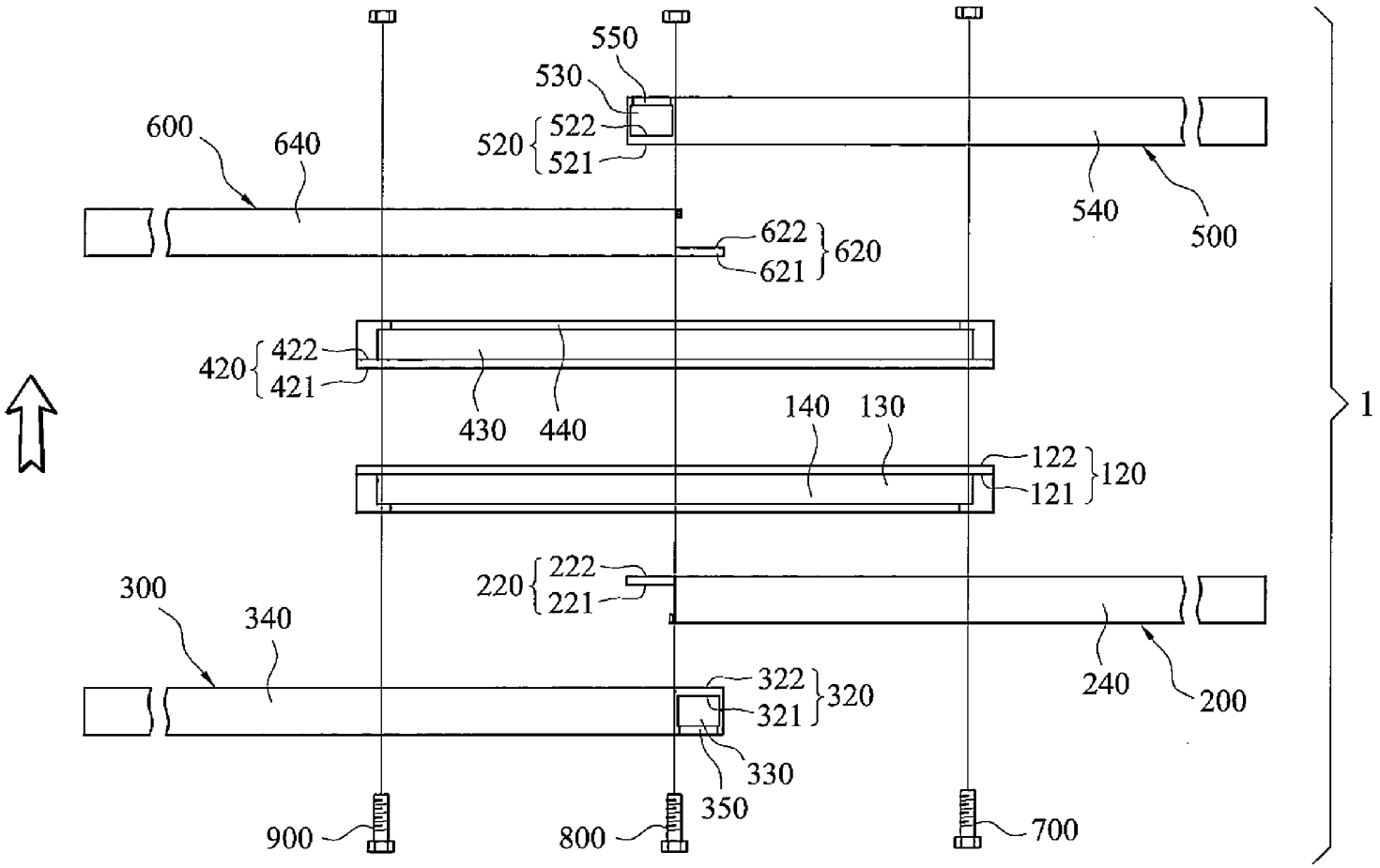
FIG. 9 illustrates a top explosion view according to another aspect of a pinnacle truss of this invention.

The second linear support member 200 has a second central axis line 210 intersecting the first central axis line 110. The second linear support member 200 comprises a second plate 220, a second front wall 230, a second rear wall 240, a second front eaves 250 and a second rear eaves 260. The second plate 220 extends along the second central axis line 210. The second plate 220 comprises a second top surface 221 and a second bottom surface 222 opposite to the second top surface 221. A segment of the second bottom surface 222 positioned at one end (a right end) of the second plate 220 is stacked and attached on a segment of the first top surface 121 positioned at one end (a right end) of the first plate 120. The second front wall 230 and the second rear wall 240 are formed on the second top surface 221 via bending from both sides (a front side and a rear side) of the second plate 220 with an angle of generally 90 degrees, respectively, and extending along the second central axis line 210. The second front wall 230 is located between the first wall 130 and the second rear wall 240. The second front eaves 250 and the second rear eaves 260 are located above the second top surface 221 via bending towards each other from one side of the second front wall 230 and one side of the second rear wall 240 with an angle of generally 90 degrees, respectively, and extending along the second central axis line 210. The second front eaves 250, the second front wall 230, the second plate 220, the second rear wall 240 and the second rear eaves 260 form a C-shaped cross section in a radial direction of the second linear support member 200 (as illustrated in FIG. 6). For example, the second linear support member 200 can be formed by cutting C-shaped steel, but not limited to this specific material or this forming method.

The third linear support member 300 has a third central axis line 310 intersecting the first central axis line 110 and the second central axis line 201. The third linear support member 300 comprises a third plate 320, a third front wall 330, a third rear wall 340, a third front eaves 350 and a third rear eaves 360. The third plate 320 extends along the third central axis line 310. The third plate 320 comprises a third top surface 321 and a third bottom surface 322 opposite to the third top surface 321. Segments of the third bottom surface 322 positioned at one end (a right end) and the other end (a left end) of the third plate 320 are stacked and attached on a segment of the second top surface 221 positioned at the other end (a left end) of the second plate 220 and a segment of the first top surface 121 positioned at the other end (a left end) of the first plate 120, respectively. The third front wall 330 and the third rear wall 340 are formed on the third top surface 321 via bending from both sides (a front side and a rear side) of the third plate 320 with an angle of generally 90 degrees, respectively, and extending along the third central axis line 310. The third front wall 330 is located between the first wall 130 and the third rear wall 340. The third front eaves 350 and the third rear eaves 360 are located above the third top surface 321 via bending towards each other from one side of the third front wall 330 and one side of the third rear wall 340 with an angle of generally 90 degrees, respectively, and extending along the third central axis line 310. The third front eaves 350, the third front wall 330, the third plate 320, the third rear wall 340 and the third rear eaves 360 form a C-shaped cross section in a radial direction of the third linear support member 300 (as illustrated in FIG. 6). For example, the third linear support member 300 can be formed by cutting C-shaped steel, but not limited to this specific material or this forming method. Accordingly, the sequence is arranged from the first linear support member 100, the second linear support member 200 to the third linear support member 300.

In this embodiment, the pinnacle truss 1 further comprises a first locking member 700 penetrating the first plate 120 and the second plate 220 at the intersection of the first central axis line 110 and the second central axis line 210, a second locking member 800 penetrating the second plate 220 and the third plate 320 at the intersection of the second central axis line 210 and the third central axis line 310 and a third locking member 900 penetrating the first plate 120 and the third plate 320 at the intersection of the first central axis line 110 and the third central axis line 310. The first linear support member 100, the second linear support member 200 and the third linear support member 300 are locked to one another as a firm triangular support structure through the first locking member 700, the second locking member 800 and the third locking member 900. For example, the first locking member 700, the second locking member 800 and the third locking member 900 can be, but not limited to, screws or rivets.

Specifically, the first plate 120 has a first main through hole 123 and a first secondary through hole 124 at portions thereof stacked on the second plate 220 and the third plate 320, respectively, on the first central axis line 110, the second plate 220 has a second main through hole 223 and a second secondary through hole 224 at portions thereof stacked on the first plate 120 and the third plate 320, respectively, on the second central axis line 210, the third plate 320 has a third main through hole 323 and a third secondary through hole 324 at portions thereof stacked on the second plate 220 and the first plate 120, respectively, on the third central axis line 310, the first main through hole 123 and the second main through hole 223 overlap with each other for the penetration of the first locking member 700, the second secondary through hole 224 and the third main through hole 323 overlap with each other for the penetration of the second locking member 800, and the first secondary through hole 124 and the third secondary through hole 324 overlap with each other for the penetration of the third locking member 900. For example, while the first locking member 700, the second locking member 800 and the third locking member 900 are screws, the first main through hole 123, the first secondary through hole 124, the second main through hole 223, the second secondary through hole 224, the third main through hole 323 and the third secondary through hole 324 are screw holes.

In an aspect, the first wall 130 abuts against the second front wall 230 or the second front eaves 250. In an aspect, the first wall 130 abuts against the third front wall 330 or the third front eaves 350. In an aspect, the first eaves 140 abuts against the second front wall 230 or the second front eaves 250. In an aspect, the first eaves 140 abuts against the third front wall 330 or the third front eaves 350. In an aspect, the second front wall 230 abuts against the third front wall 330 or the third front eaves 350. In an aspect, the second front eaves 250 abuts against the third front wall 330 or the third front eaves 350. In an aspect, the second rear wall 240 abuts against the third rear wall 340 or the third rear eaves 360. In an aspect, the second rear eaves 260 abuts against the third rear wall 340 or the third rear eaves 360. This embodiment can be any adequate combination of the above aspects. Alternatively, at least one of the above aspects will not be performed.

In this embodiment, a width L1 of the first linear support member 100 in the radial direction thereof, a width L2 of the second linear support member 200 in the radial direction thereof and a width L3 of the third linear support member 300 in the radial direction thereof are equivalent to one another.

Accordingly, since the first linear support member 100, the second linear support member 200 and the third linear support member 300 form a triangular structure with three connection points, and since the second linear support member 200 and the third linear support member 300 are directly connected to each other without any gap therebetween, any potential stress and strain can be eliminated for strengthening the overall structure of the pinnacle truss 1.

According to FIGS. 1 to 7, in another embodiment of this invention, the pinnacle truss 1 further comprises a fourth linear support member 400, a fifth linear support member 500 and a sixth linear support member 600. Since the fourth linear support member 400, the fifth linear support member 500 and the sixth linear support member 600 are similar to the first linear support member 100, the second linear support member 200 and the third linear support member 300, respectively, similar structures will not be described further more.

The fourth linear support member 400 has a fourth central axis line 410 parallel to the first central axis line 110. The fourth linear support member 400 comprises a fourth plate 420, a fourth wall 430 and a fourth eaves 440. The fourth plate 420 extends along the fourth central axis line 410. The fourth plate 420 comprises a fourth top surface 421 and a fourth bottom surface 422 opposite to the fourth top surface 421. Segments of the fourth bottom surface 422 positioned at one end and the other end of the fourth plate 420 are stacked and attached on segments of the first bottom surface 122 positioned at one end and the other end of the first plate 120, respectively. The fourth wall 430 is formed on the fourth top surface 421 via bending from one side of the fourth plate 420 and extending along the fourth central axis line 410. The fourth wall 430 corresponds to the first wall 130. In particular, the fourth wall 430 is aligned with the first wall 130. The fourth eaves 440 is located above the fourth top surface 421 via bending from one side of the fourth wall 430 and extending axially along the fourth central axis line 410. The fourth eaves 440, the fourth wall 430 and the fourth plate 420 form an L-shaped cross section in a radial direction of the fourth linear support member 400. The fourth eaves 440 corresponds to the first eaves 140. In particular, the fourth eaves 440 is aligned with the first eaves 140. For example, the fourth linear support member 400 can be formed by cutting C-shaped steel, but not limited to this specific material or this forming method.

The fifth linear support member 500 has a fifth central axis line 510 intersecting the fourth central axis line 410 and parallel to the second central axis line 210. The fifth linear support member 500 comprises a fifth plate 520, a fifth front wall 530, a fifth rear wall 540, a fifth front eaves 550 and a fifth rear eaves 560. The fifth plate 520 extends along the fifth central axis line 510. The fifth plate 520 comprises a fifth top surface 521 and a fifth bottom surface 522 opposite to the fifth top surface 521. Segments of the fifth bottom surface 522 positioned at one end and the other end of the fifth plate 520 are stacked and attached on a segment of the fourth top surface 421 positioned at one end of the fourth plate 420 and a segment of the second bottom surface 222 positioned at the other end of the second plate 220, respectively. The fifth front wall 530 and the fifth rear wall 540 are formed on the fifth top surface 521 via bending from both sides of the fifth plate 520, respectively, and extending along the fifth central axis line 510. The fifth front wall 530 is located between the fourth wall 430 and the fifth rear wall 540. The fifth front wall 530 corresponds to the second front wall 230. The fifth rear wall 540 corresponds to the second rear wall 240. In particular, the fifth front wall 530 is aligned with the second front wall 230, and the fifth rear wall 540 is aligned with the second rear wall 240. The fifth front eaves 550 and the fifth rear eaves 560 are located above the fifth top surface 521 via bending towards each other from one side of the fifth front wall 530 and one side of the fifth rear wall 540, respectively, and extending along the fifth central axis line 510. The fifth front eaves 550, the fifth front wall 530, the fifth plate 520, the fifth rear wall 540 and the fifth rear eaves 560 form a C-shaped cross section in a radial direction of the fifth linear support member 500. The fifth front eaves 550 corresponds to the second front eaves 250.

The fifth rear eaves 560 corresponds to the second rear eaves 260. In particular, the fifth front eaves 550 is aligned with the second front eaves 250, and the fifth rear eaves 560 is aligned with the second rear eaves 260. For example, the fifth linear support member 500 can be formed by cutting C-shaped steel, but not limited to this specific material or this forming method.

The sixth linear support member 600 has a sixth central axis line 610 intersecting the fourth central axis line 410 and the fifth central axis line 510 and parallel to the third central axis line 310. The sixth linear support member 600 comprises a sixth plate 620, a sixth front wall 630, a sixth rear wall 640, a sixth front eaves 650 and a sixth rear eaves 660. The sixth plate 620 extends along the sixth central axis line 610. The sixth plate 620 comprises a sixth top surface 621 and a sixth bottom surface 622 opposite to the sixth top surface 621. Segments of the sixth bottom surface 622 positioned at one end and the other end of the sixth plate 620 are stacked and attached on a segment of the fifth top surface 521 positioned at the other end of the fifth plate 520 and a segment of the fourth top surface 421 positioned at the other end of the fourth plate 420, respectively. The sixth front wall 630 and the sixth rear wall 640 are formed on the sixth top surface 621 via bending from both sides of the sixth plate 620, respectively, and extending along the sixth central axis line 610. The sixth front wall 630 is located between the fourth wall 430 and the sixth rear wall 640. The sixth front wall 630 corresponds to the third front wall 330. The sixth rear wall 640 corresponds to the third rear wall 340. In particular, the sixth front wall 630 is aligned with the third front wall 330, and the sixth rear wall 640 is aligned with the third rear wall 340. The sixth front eaves 650 and the sixth rear eaves 660 are located above the sixth top surface 621 via bending towards each other from one side of the sixth front wall 630 and one side of the sixth rear wall 640, respectively, and extending along the sixth central axis line 610. The sixth front eaves 650, the sixth front wall 630, the sixth plate 620, the sixth rear wall 640 and the sixth rear eaves 660 form a C-shaped cross section in a radial direction of the sixth linear support member 600. The sixth front eaves 650 corresponds to the third front eaves 350. The sixth rear eaves 660 corresponds to the third rear eaves 360. In particular, the sixth front eaves 650 is aligned with the third front eaves 350, and the sixth rear eaves 660 is aligned with the third rear eaves 360. For example, the sixth linear support member 600 can be formed by cutting C-shaped steel, but not limited to this specific material or this forming method. Accordingly, the sequence is arranged from the third linear support member 300, the second linear support member 200, the first linear support member 100, the fourth linear support member 400, the fifth linear support member 500 to the sixth linear support member 600.

According to FIGS. 6 to 9, in further embodiment of this invention, the pinnacle truss 1 further comprises a fourth linear support member 400, a fifth linear support member 500 and a sixth linear support member 600. Since compared to the above embodiment, the difference is in that the sequence of the fifth linear support member 500 and the sixth linear support member 600 are reversed, similar structures will not be described further more.

The fourth linear support member 400 has a fourth central axis line 410 parallel to the first central axis line 110. The fourth linear support member 400 comprises a fourth plate 420, a fourth wall 430 and a fourth eaves 440. The fourth plate 420 extends along the fourth central axis line 410. The fourth plate 420 comprises a fourth top surface 421 and a fourth bottom surface 422 opposite to the fourth top surface 421. The fourth bottom surface 422 is stacked and attached on the first bottom surface 122. The fourth wall 430 is formed on the fourth top surface 421 via bending from one side of the fourth plate 420 and extending along the fourth central axis line 410. The fourth wall 430 corresponds to the first wall 130. The fourth eaves 440 is located above the fourth top surface 421 via bending from one side of the fourth wall 430 and extending axially along the fourth central axis line 410. The fourth eaves 440, the fourth wall 430 and the fourth plate 420 form an L-shaped cross section in a radial direction of the fourth linear support member 400. The fourth eaves 440 corresponds to the first eaves 140. For example, the fourth linear support member 400 can be formed by cutting C-shaped steel, but not limited to this specific material or this forming method.

The fifth linear support member 500 has a fifth central axis line 510 intersecting the fourth central axis line 410 and parallel to the second central axis line 210. The fifth linear support member 500 comprises a fifth plate 520, a fifth front wall 530, a fifth rear wall 540, a fifth front eaves 550 and a fifth rear eaves 560. The fifth plate 520 extends along the fifth central axis line 510. The fifth plate 520 comprises a fifth top surface 521 and a fifth bottom surface 522 opposite to the fifth top surface 521. A segment of the fifth bottom surface 522 positioned at one end of the fifth plate 520 is stacked and attached on a segment of the fourth top surface 421 positioned at one end of the fourth plate 420. The fifth front wall 530 and the fifth rear wall 540 are formed on the fifth top surface 521 via bending from both sides of the fifth plate 520, respectively, and extending along the fifth central axis line 510. The fifth front wall 530 is located between the fourth wall 430 and the fifth rear wall 540. The fifth front wall 530 corresponds to the second front wall 230. The fifth rear wall 540 corresponds to the second rear wall 240. The fifth front eaves 550 and the fifth rear eaves 560 are located above the fifth top surface 521 via bending towards each other from one side of the fifth front wall 530 and one side of the fifth rear wall 540, respectively, and extending along the fifth central axis line 510. The fifth front eaves 550, the fifth front wall 530, the fifth plate 520, the fifth rear wall 540 and the fifth rear eaves 560 form a C-shaped cross section in a radial direction of the fifth linear support member 500. The fifth front eaves 550 corresponds to the second front eaves 250. The fifth rear eaves 560 corresponds to the second rear eaves 260. For example, the fifth linear support member 500 can be formed by cutting C-shaped steel, but not limited to this specific material or this forming method.

The sixth linear support member 600 has a sixth central axis line 610 intersecting the fourth central axis line 410 and the fifth central axis line 510 and parallel to the third central axis line 310. The sixth linear support member 600 comprises a sixth plate 620, a sixth front wall 630, a sixth rear wall 640, a sixth front eaves 650 and a sixth rear eaves 660. The sixth plate 620 extends along the sixth central axis line 610. The sixth plate 620 comprises a sixth top surface 621 and a sixth bottom surface 622 opposite to the sixth top surface 621. Segments of the sixth bottom surface 622 positioned at one end and the other end of the sixth plate 620 are stacked and attached on a segment of the second bottom surface 222 positioned at the other end of the second plate 220 and a segment of the fourth top surface 421 positioned at the other end of the fourth plate 420, respectively. A segment of the fifth bottom surface 522 positioned at the other end of the fifth plate 520 is stacked and attached on a segment of the sixth top surface 621 positioned at one end of the sixth plate 620. The sixth front wall 630 and the sixth rear wall 640 are formed on the sixth top surface 621 via bending from both sides of the sixth plate 620, respectively, and extending along the sixth central axis line 610. The sixth front wall 630 is located between the fourth wall 430 and the sixth rear wall 640. The sixth front wall 630 corresponds to the third front wall 330. The sixth rear wall 640 corresponds to the third rear wall 340. The sixth front eaves 650 and the sixth rear eaves 660 are located above the sixth top surface 621 via bending towards each other from one side of the sixth front wall 630 and one side of the sixth rear wall 640, respectively, and extending along the sixth central axis line 610. The sixth front eaves 650, the sixth front wall 630, the sixth plate 620, the sixth rear wall 640 and the sixth rear eaves 660 form a C-shaped cross section in a radial direction of the sixth linear support member 600. The sixth front eaves 650 corresponds to the third front eaves 350. The sixth rear eaves 660 corresponds to the third rear eaves 360. For example, the sixth linear support member 600 can be formed by cutting C-shaped steel, but not limited to this specific material or this forming method. Accordingly, the sequence is arranged from the third linear support member 300, the second linear support member 200, the first linear support member 100, the fourth linear support member 400, the sixth linear support member 600 to the fifth linear support member 500.

According to FIGS. 1 to 9, in these embodiment, the first locking member 700 penetrates the first plate 120, the second plate 220, the fourth plate 420 and the fifth plate 520 at the intersection of the first central axis line 110 and the second central axis line 210 and the intersection of the fourth central axis line 410 and the fifth central axis line 510, the second locking member 800 penetrates the second plate 220, the third plate 320, the fifth plate 520 and the sixth plate 620 at the intersection of the second central axis line 210 and the third central axis line 310 and the intersection of the fifth central axis line 510 and the sixth central axis line 610, and the third locking member 900 penetrates the first plate 120, the third plate 320, the fourth plate 420 and the sixth plate 620 at the intersection of the first central axis line 110 and the third central axis line 310 and the intersection of the fourth central axis line 410 and the sixth central axis line 610. Accordingly, the first linear support member 100, the second linear support member 200, the third linear support member 300, the fourth linear support member 400, the fifth linear support member 500 and the sixth linear support member 600 are locked to one another as a pair of firm triangular support structures through the first locking member 700, the second locking member 800 and the third locking member 900.

Specifically, the fourth plate 420 has a fourth main through hole 423 and a fourth secondary through hole 424 at portions thereof stacked on the fifth plate 520 and the sixth plate 620, respectively, on the fourth central axis line 410, the fifth plate 520 has a fifth main through hole 523 and a fifth secondary through hole 524 at portions thereof stacked on the fourth plate 420 and the sixth plate 620, respectively, on the fifth central axis line 510, the sixth plate 620 has a sixth main through hole 623 and a sixth secondary through hole 624 at portions thereof stacked on the fifth plate 520 and the fourth plate 420, respectively, on the sixth central axis line 610, the first main through hole 123, the second main through hole 223, the fourth main through hole 423 and the fifth main through hole 523 overlap with one another for the penetration of the first locking member 700, the second secondary through hole 224, the third main through hole 323, the fifth secondary through hole 524 and the sixth main through hole 623 overlap with one another for the penetration of the second locking member 800, and the first secondary through hole 124, the third secondary through hole 324 and the fourth secondary through hole 424 and the sixth secondary through hole 624 overlap with one another for the penetration of the third locking member 900.

In an aspect, the fourth wall 430 abuts against the fifth front wall 530 or the fifth front eaves 550. In an aspect, the fourth wall 430 abuts against the sixth front wall 630 or the sixth front eaves 650. In an aspect, the fourth eaves 440 abuts against the fifth front wall 530 or the fifth front eaves 550. In an aspect, the fourth eaves 440 abuts against the sixth front wall 630 or the sixth front eaves 650. In an aspect, the fifth front wall 530 abuts against the sixth front wall 630 or the sixth front eaves 650. In an aspect, the fifth front eaves 550 abuts against the sixth front wall 630 or the sixth front eaves 650. In an aspect, the fifth rear wall 540 abuts against the sixth rear wall 540 or the sixth rear eaves 560. In an aspect, the fifth rear eaves 560 abuts against the sixth rear wall 640 or the sixth rear eaves 660. This embodiment can be any adequate combination of the above aspects.

In this embodiments, a width L1 of the first linear support member 100 in the radial direction thereof, a width L2 of the second linear support member 200 in the radial direction thereof, a width L3 of the third linear support member 300 in the radial direction thereof, a width L4 of the fourth linear support member 400 in the radial direction thereof, a width L5 of the fifth linear support member 500 in the radial direction thereof and a width L6 of the sixth linear support member 600 in the radial direction thereof are equivalent to one another.

Accordingly, this triangular support structure can bear larger strength, and thus can enhance overall performance.

The above specific embodiments will fully reveal the general nature of this invention. Others can readily modify and/or adapt specific embodiments without departing from the general concept of this invention by applying techniques in the same technical field without undue experimentation. Therefore, based on the teaching and guidance here, such adaptation and modification tend to fall within equivalent meaning and range of the disclosed embodiments. It should be understood that the phraseology or terminology herein are for the purpose of the narrative, but not for limitation, so that persons skilled in the art can understand the phraseology or terminology of this specification through referring to the teaching and guidance.

What is claimed is:

1. A pinnacle truss, comprising:

a first linear support member having a first central axis line, the first linear support member comprising:

a first plate extending along the first central axis line, the first plate comprising a first top surface and a first bottom surface opposite to the first top surface;

a first front wall formed on the first top surface via bending from one side of the first plate and extending along the first central axis line; and a first eaves located above the first top surface via bending from one side of the first front wall and extending along the first central axis line, the first eaves, the first front wall and the first plate forming an L-shaped cross section in a radial direction of the first linear support member;

a second linear support member having a second central axis line intersecting the first central axis line, the second linear support member comprising:

a second plate extending along the second central axis line, the second plate comprising a second top surface and a second bottom surface opposite to the second top surface, a segment of the second bottom surface positioned at one end of the second plate being stacked on a segment of the first top surface positioned at one end of the first plate;

a second front wall and a second rear wall formed on the second top surface via bending from both sides of the second plate, respectively, and extending along the second central axis line, the second front wall being located between the first front wall and the second rear wall; and a second front eaves and a second rear eaves located above the second top surface via bending towards each other from one side of the second front wall and one side of the second rear wall, respectively, and extending along the second central axis line, the second front eaves, the second front wall, the second plate, the second rear wall and the second rear eaves forming a C-shaped cross section in a radial direction of the second linear support member; and a third linear support member having a third central axis line intersecting the first central axis line and the second central axis line, the third linear support member comprising:

a third plate extending along the third central axis line, the third plate comprising a third top surface and a third bottom surface opposite to the third top surface, segments of the third bottom surface positioned at one end and the other end of the third plate being stacked on a segment of the second top surface positioned at the other end of the second plate and a segment of the first top surface positioned at the other end of the first plate, respectively;

a third front wall and a third rear wall formed on the third top surface via bending from both sides of the third plate, respectively, and extending along the third central axis line, the third front wall being located between the first front wall and the third rear wall; and a third front eaves and a third rear eaves located above the third top surface via bending towards each other from one side of the third front wall and one side of the third rear wall, respectively, and extending along the third central axis line, the third front eaves, the third front wall, the third plate, the third rear wall and the third rear eaves forming a C-shaped cross section in a radial direction of the third linear support member;

a fourth linear support member having a fourth central axis line parallel to the first central axis line, the fourth linear support member comprising:

a fourth plate extending along the fourth central axis line, the fourth plate comprising a fourth top surface and a fourth bottom surface opposite to the fourth top surface, segments of the fourth bottom surface positioned at one end and the other end of the fourth plate being stacked on segments of the first bottom surface positioned at one end and the other end of the first plate, respectively;

a fourth front wall formed on the fourth top surface via bending from one side of the fourth plate and extending along the fourth central axis line, the fourth front wall corresponding to the first front wall; and a fourth eaves located above the fourth top surface via bending from one side of the fourth front wall and extending axially along the fourth central axis line, the fourth eaves, the fourth front wall and the fourth plate forming an L-shaped cross section in a radial direction of the fourth linear support member, the fourth eaves corresponding to the first eaves;

a fifth linear support member having a fifth central axis line intersecting the fourth central axis line and parallel to the second central axis line, the fifth linear support member comprising:

a fifth plate extending along the fifth central axis line, the fifth plate comprising a fifth top surface and a fifth bottom surface opposite to the fifth top surface, segments of the fifth bottom surface positioned at one end and the other end of the fifth plate being stacked on a segment of the fourth top surface positioned at one end of the fourth plate and a segment of the second bottom surface positioned at the other end of the second plate, respectively;

a fifth front wall and a fifth rear wall formed on the fifth top surface via bending from both sides of the fifth plate, respectively, and extending along the fifth central axis line, the fifth front wall being located between the fourth front wall and the fifth rear wall, the fifth front wall corresponding to the second front wall, the fifth rear wall corresponding to the second rear wall; and a fifth front eaves and a fifth rear eaves located above the fifth top surface via bending towards each other from one side of the fifth front wall and one side of the fifth rear wall, respectively, and extending along the fifth central axis line, the fifth front eaves, the fifth front wall, the fifth plate, the fifth rear wall and the fifth rear eaves forming a C-shaped cross section in a radial direction of the fifth linear support member, the fifth front eaves corresponding to the second front eaves, the fifth rear eaves corresponding to the second rear eaves; and a sixth linear support member having a sixth central axis line intersecting the fourth central axis line and the fifth central axis line and parallel to the third central axis line, the sixth linear support member comprising:

a sixth plate extending along the sixth central axis line, the sixth plate comprising a sixth top surface and a sixth bottom surface opposite to the sixth top surface, segments of the sixth bottom surface positioned at one end and the other end of the sixth plate being stacked on a segment of the fifth top surface positioned at the other end of the fifth plate and a segment of the fourth top surface positioned at the other end of the fourth plate, respectively;

a sixth front wall and a sixth rear wall formed on the sixth top surface via bending from both sides of the sixth plate, respectively, and extending along the sixth central axis line, the sixth front wall being located between the fourth front wall and the sixth rear wall, the sixth front wall corresponding to the third front wall, the sixth rear wall corresponding to the third rear wall; and a sixth front eaves and a sixth rear eaves located above the sixth top surface via bending towards each other from one side of the sixth front wall and one side of the sixth rear wall, respectively, and extending along the sixth central axis line, the sixth front eaves, the sixth front wall, the sixth plate, the sixth rear wall and the sixth rear eaves forming a C-shaped cross section in a radial direction of the sixth linear support member, the sixth front eaves corresponding to the third front eaves, the sixth rear eaves corresponding to the third rear eaves.

2. According to the pinnacle truss of claim 1, further comprising a first locking member penetrating the first plate, the second plate, the fourth plate and the fifth plate at the intersection of the first central axis line and the second central axis line and the intersection of the fourth central axis line and the fifth central axis line, a second locking member penetrating the second plate, the third plate, the fifth plate and the sixth plate at the intersection of the second central axis line and the third central axis line and the intersection of the fifth central axis line and the sixth central axis line and a third locking member penetrating the first plate, the third plate, the fourth plate and the sixth plate at the intersection of the first central axis line and the third central axis line and the intersection of the fourth central axis line and the sixth central axis line.

3. According to the pinnacle truss of claim 2, wherein the first plate has a first main through hole and a first secondary through hole at portions thereof stacked on the second plate and the third plate, respectively, on the first central axis line, the second plate has a second main through hole and a second secondary through hole at portions thereof stacked on the first plate and the third plate, respectively, on the second central axis line, the third plate has a third main through hole and a third secondary through hole at portions thereof stacked on the second plate and the first plate, respectively, on the third central axis line, the fourth plate has a fourth main through hole and a fourth secondary through hole at portions thereof stacked on the fifth plate and the sixth plate, respectively, on the fourth central axis line, the fifth plate has a fifth main through hole and a fifth secondary through hole at portions thereof stacked on the fourth plate and the sixth plate, respectively, on the fifth central axis line, the sixth plate has a sixth main through hole and a sixth secondary through hole at portions thereof stacked on the fifth plate and the fourth plate, respectively, on the sixth central axis line, the first main through hole, the second main through hole, the fourth main through hole and the fifth main through hole overlap with one another for the penetration of the first locking member, the second secondary through hole, the third main through hole, the fifth secondary through hole and the sixth main through hole overlap with one another for the penetration of the second locking member, and the first secondary through hole, the third secondary through hole and the fourth secondary through hole and the sixth secondary through hole overlap with one another for the penetration of the third locking member.

4. According to the pinnacle truss of claim 1, wherein a width of the first linear support member in the radial direction thereof, a width of the second linear support member in the radial direction thereof, a width of the third linear support member in the radial direction thereof, a width of the fourth linear support member in the radial direction thereof, a width of the fifth linear support member in the radial direction thereof and a width of the sixth linear support member in the radial direction thereof are equivalent to one another.

5. A pinnacle truss, comprising:

a first linear support member having a first central axis line, the first linear support member comprising:

a first plate extending along the first central axis line, the first plate comprising a first top surface and a first bottom surface opposite to the first top surface;

a first front wall formed on the first top surface via bending from one side of the first plate and extending along the first central axis line; and a first eaves located above the first top surface via bending from one side of the first front wall and extending along the first central axis line, the first eaves, the first front wall and the first plate forming an L-shaped cross section in a radial direction of the first linear support member;

a second linear support member having a second central axis line intersecting the first central axis line, the second linear support member comprising:

a second plate extending along the second central axis line, the second plate comprising a second top surface and a second bottom surface opposite to the second top surface, a segment of the second bottom surface positioned at one end of the second plate being stacked on a segment of the first top surface positioned at one end of the first plate;

a second front wall and a second rear wall formed on the second top surface via bending from both sides of the second plate, respectively, and extending along the second central axis line, the second front wall being located between the first front wall and the second rear wall; and a second front eaves and a second rear eaves located above the second top surface via bending towards each other from one side of the second front wall and one side of the second rear wall, respectively, and extending along the second central axis line, the second front eaves, the second front wall, the second plate, the second rear wall and the second rear eaves forming a C-shaped cross section in a radial direction of the second linear support member; and a third linear support member having a third central axis line intersecting the first central axis line and the second central axis line, the third linear support member comprising:

a third plate extending along the third central axis line, the third plate comprising a third top surface and a third bottom surface opposite to the third top surface, segments of the third bottom surface positioned at one end and the other end of the third plate being stacked on a segment of the second top surface positioned at the other end of the second plate and a segment of the first top surface positioned at the other end of the first plate, respectively;

a third front wall and a third rear wall formed on the third top surface via bending from both sides of the third plate, respectively, and extending along the third central axis line, the third front wall being located between the first front wall and the third rear wall; and a third front eaves and a third rear eaves located above the third top surface via bending towards each other from one side of the third front wall and one side of the third rear wall, respectively, and extending along the third central axis line, the third front eaves, the third front wall, the third plate, the third rear wall and the third rear eaves forming a C-shaped cross section in a radial direction of the third linear support member;

a fourth linear support member having a fourth central axis line parallel to the first central axis line, the fourth linear support member comprising:

a fourth plate extending along the fourth central axis line, the fourth plate comprising a fourth top surface and a fourth bottom surface opposite to the fourth top surface, segments of the fourth bottom surface positioned at one end and the other end of the fourth plate being stacked on segments of the first bottom surface positioned at one end and the other end of the first plate, respectively;

a fourth front wall formed on the fourth top surface via bending from one side of the fourth plate and extending along the fourth central axis line, the fourth front wall corresponding to the first front wall; and a fourth eaves located above the fourth top surface via bending from one side of the fourth front wall and extending axially along the fourth central axis line, the fourth eaves, the fourth front wall and the fourth plate forming an L-shaped cross section in a radial direction of the fourth linear support member, the fourth eaves corresponding to the first eaves;

a fifth linear support member having a fifth central axis line intersecting the fourth central axis line and parallel to the second central axis line, the fifth linear support member comprising:

a fifth plate extending along the fifth central axis line, the fifth plate comprising a fifth top surface and a fifth bottom surface opposite to the fifth top surface, a segment of the fifth bottom surface positioned at one end of the fifth plate being stacked on a segment of the fourth top surface positioned at one end of the fourth plate;

a fifth front wall and a fifth rear wall formed on the fifth top surface via bending from both sides of the fifth plate, respectively, and extending along the fifth central axis line, the fifth front wall being located between the fourth front wall and the fifth rear wall, the fifth front wall corresponding to the second front wall, the fifth rear wall corresponding to the second rear wall; and a fifth front eaves and a fifth rear eaves located above the fifth top surface via bending towards each other from one side of the fifth front wall and one side of the fifth rear wall, respectively, and extending along the fifth central axis line, the fifth front eaves, the fifth front wall, the fifth plate, the fifth rear wall and the fifth rear eaves forming a C-shaped cross section in a radial direction of the fifth linear support member, the fifth front eaves corresponding to the second front eaves, the fifth rear eaves corresponding to the second rear eaves; and a sixth linear support member having a sixth central axis line intersecting the fourth central axis line and the fifth central axis line and parallel to the third central axis line, the sixth linear support member comprising:

a sixth plate extending along the sixth central axis line, the sixth plate comprising a sixth top surface and a sixth bottom surface opposite to the sixth top surface, segments of the sixth bottom surface positioned at one end and the other end of the sixth plate being stacked on a segment of the second bottom surface positioned at the other end of the second plate and a segment of the fourth top surface positioned at the other end of the fourth plate, a segment of the fifth bottom surface positioned at the other end of the fifth plate being stacked on a segment of the sixth top surface positioned at one end of the sixth plate;

a sixth front wall and a sixth rear wall formed on the sixth top surface via bending from both sides of the sixth plate, respectively, and extending along the sixth central axis line, the sixth front wall being located between the fourth front wall and the sixth rear wall, the sixth front wall corresponding to the third front wall, the sixth rear wall corresponding to the third rear wall; and a sixth front eaves and a sixth rear eaves located above the sixth top surface via bending towards each other from one side of the sixth front wall and one side of the sixth rear wall, respectively, and extending along the sixth central axis line, the sixth front eaves, the sixth front wall, the sixth plate, the sixth rear wall and the sixth rear eaves forming a C-shaped cross section in a radial direction of the sixth linear support member, the sixth front eaves corresponding to the third front eaves, the sixth rear eaves corresponding to the third rear eaves.

6. According to the pinnacle truss of claim 5, further comprising a first locking member penetrating the first plate, the second plate, the fourth plate and the fifth plate at the intersection of the first central axis line and the second central axis line and the intersection of the fourth central axis line and the fifth central axis line, a second locking member penetrating the second plate, the third plate, the fifth plate and the sixth plate at the intersection of the second central axis line and the third central axis line and the intersection of the fifth central axis line and the sixth central axis line and a third locking member penetrating the first plate, the third plate, the fourth plate and the sixth plate at the intersection of the first central axis line and the third central axis line and the intersection of the fourth central axis line and the sixth central axis line.

7. According to the pinnacle truss of claim 6, wherein the first plate has a first main through hole and a first secondary through hole at portions thereof stacked on the second plate and the third plate, respectively, on the first central axis line, the second plate has a second main through hole and a second secondary through hole at portions thereof stacked on the first plate and the third plate, respectively, on the second central axis line, the third plate has a third main through hole and a third secondary through hole at portions thereof stacked on the second plate and the first plate, respectively, on the third central axis line, the fourth plate has a fourth main through hole and a fourth secondary through hole at portions thereof stacked on the fifth plate and the sixth plate, respectively, on the fourth central axis line, the fifth plate has a fifth main through hole and a fifth secondary through hole at portions thereof stacked on the fourth plate and the sixth plate, respectively, on the fifth central axis line, the sixth plate has a sixth main through hole and a sixth secondary through hole at portions thereof stacked on the fifth plate and the fourth plate, respectively, on the sixth central axis line, the first main through hole, the second main through hole, the fourth main through hole and the fifth main through hole overlap with one another for the penetration of the first locking member, the second secondary through hole, the third main through hole, the fifth secondary through hole and the sixth main through hole overlap with one another for the penetration of the second locking member, and the first secondary through hole, the third secondary through hole and the fourth secondary through hole and the sixth secondary through hole overlap with one another for the penetration of the third locking member.

8. According to the pinnacle truss of claim 5, wherein a width of the first linear support member in the radial direction thereof, a width of the second linear support member in the radial direction thereof, a width of the third linear support member in the radial direction thereof, a width of the fourth linear support member in the radial direction thereof, a width of the fifth linear support member in the radial direction thereof and a width of the sixth linear support member in the radial direction thereof are equivalent to one another.

* * * * *